US006814640B1

(12) United States Patent
Houck

(10) Patent No.: US 6,814,640 B1
(45) Date of Patent: Nov. 9, 2004

(54) SWIM FIN

(76) Inventor: Michael Houck, P.O. Box 478, Dubois, WY (US) 82513

( * ) Notice: Subject to any disclaimer, the term of this patent is extended or adjusted under 35 U.S.C. 154(b) by 0 days.

(21) Appl. No.: 10/614,405

(22) Filed: Jul. 7, 2003

(51) Int. Cl.[7] ..... A63B 31/08
(52) U.S. Cl. ..... 441/64
(58) Field of Search ..... 441/64

(56) References Cited

U.S. PATENT DOCUMENTS

| | | | | |
|---|---|---|---|---|
| 219,560 | A | 9/1879 | Chesney | |
| 350,801 | A | 10/1886 | Dagnino | |
| 415,811 | A | 11/1889 | Chen | |
| 427,270 | A | 5/1890 | Harwell, IV et al. | |
| 445,473 | A | 1/1891 | Harwell, IV et al. | |
| 449,362 | A | 3/1891 | Evans | |
| 802,306 | A | 10/1905 | McKittrick | |
| 1,788,013 | A | 1/1931 | Christianson | |
| 2,950,487 | A | 8/1960 | Woods | |
| 3,068,499 | A | 12/1962 | Biskupsky | |
| 3,315,286 | A | 4/1967 | Brion | |
| 3,328,812 | A | 7/1967 | Berthoit | |
| 3,521,312 | A * | 7/1970 | Ganev | 441/64 |
| 4,007,506 | A | 2/1977 | Rasmussen | |
| 4,209,866 | A | 7/1980 | Loeffler | |
| 4,410,295 | A * | 10/1983 | Ersoy et al. | 403/122 |
| 4,657,515 | A | 4/1987 | Ciccotelli | |
| 4,752,259 | A | 6/1988 | Tackett | |
| 4,767,368 | A | 8/1988 | Ciccotelli | |
| 4,773,885 | A | 9/1988 | Ciccotelli | |
| 4,787,871 | A * | 11/1988 | Tomlinson | 441/61 |
| 4,807,519 | A | 2/1989 | Gil | |
| 4,869,696 | A | 9/1989 | Ciccotelli | |
| 5,292,272 | A | 3/1994 | Grim | |
| 5,304,080 | A | 4/1994 | Dilger | |
| 5,362,268 | A | 11/1994 | Nordbeck et al. | |
| 5,447,457 | A | 9/1995 | Kamitani | |
| 5,924,902 | A | 7/1999 | Burns et al. | |
| 6,155,898 | A | 12/2000 | Burns et al. | |
| 6,183,327 | B1 | 2/2001 | Meyer | |
| 6,247,982 | B1 | 6/2001 | Walker | |
| 6,322,411 | B1 * | 11/2001 | Evans | 441/64 |

FOREIGN PATENT DOCUMENTS

| | | | | |
|---|---|---|---|---|
| EP | 0 310 828 | * | 4/1989 | 441/64 |

* cited by examiner

*Primary Examiner*—Stephen Avila
(74) *Attorney, Agent, or Firm*—Allen, Dyer, Doppelt, Milbrath & Gilchrist, P.A.

(57) ABSTRACT

A swim fin comprises a foot portio and a web portion. The foot portion has a shoe for receiving the foot of a wearer and has a plurality of openings in a toe end of the foot portion. The web portion extends from the foot portion and has a first end, a second end, a plurality of support members having web material associated therewith, and a plurality of bosses positioned adjacent the first end connected with the plurality of openings. In an embodiment of the swim fin, a toe end of the foot portion is curved relative to an imaginary plane extending along a lower surface of the foot portion and has the plurality of openings along a surface of the toe end.

34 Claims, 7 Drawing Sheets

SWIM FIN

FIELD OF THE INVENTION

The present invention relates to the field of swim fins and associated methods of swimming.

SUMMARY OF THE INVENTION

With the foregoing in mind, the present invention advantageously provides a swim fin comprising a foot portion and a web portion. The foot portion has a shoe for receiving the foot of a wearer and has a plurality of openings in a toe end of the shoe. The web portion extends from the foot portion and has a first end, a second end, a plurality of support members having web material associated therewith, and a plurality of bosses positioned adjacent the first end and detachably connected with the plurality of openings.

BRIEF DESCRIPTION OF THE DRAWINGS

Some of the features of the present swim fin been stated, others will become apparent as the description proceeds when taken in conjunction with the accompanying drawings, presented for solely for exemplary purposes and not with intent to limit the invention thereto, and in which.

DETAILED DESCRIPTION OF THE PREFERRED EMBODIMENT

Figure 1:
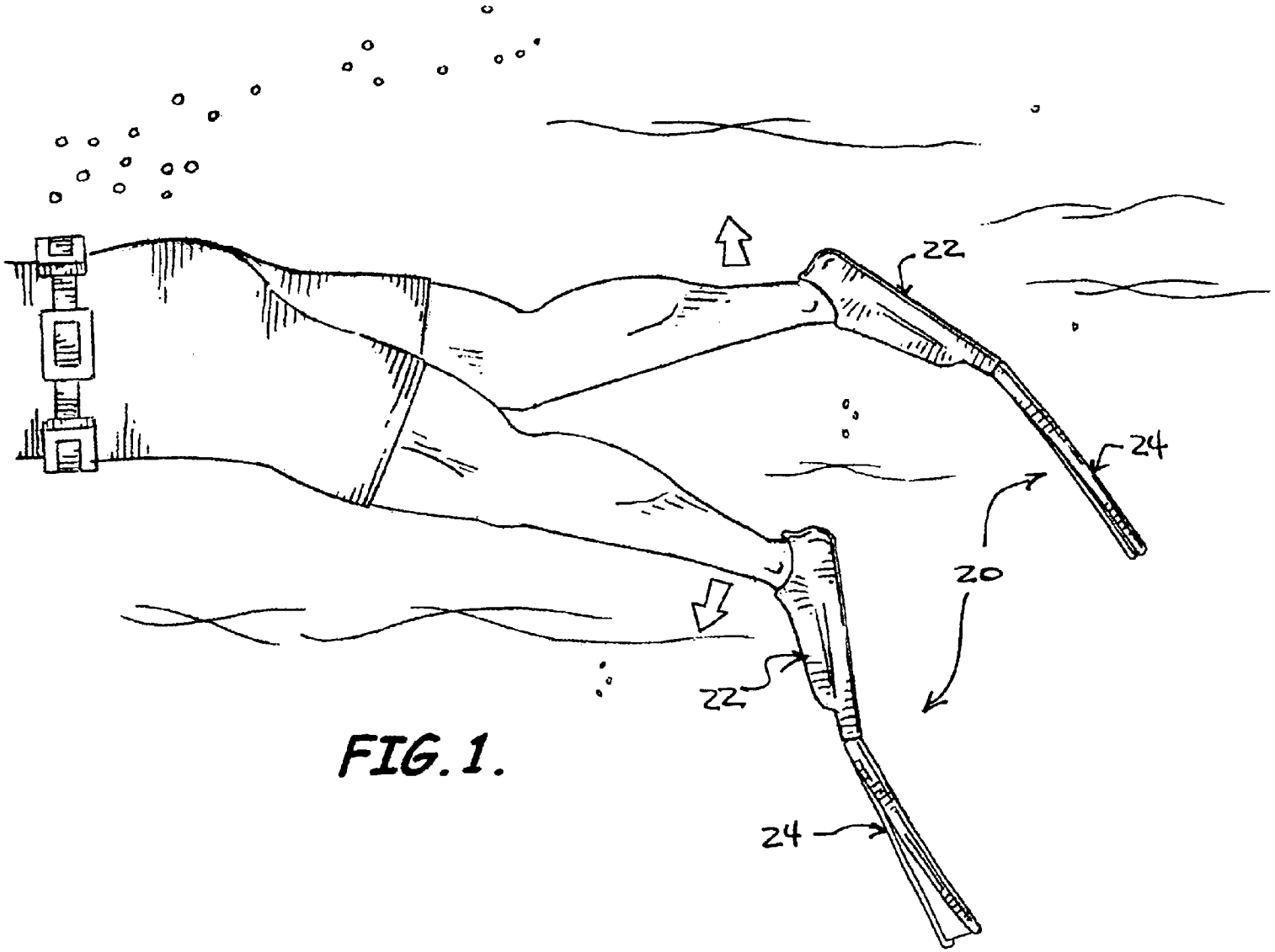
FIG. 1 is a side elevation view of the swim fin in use according to an embodiment of the present invention.

The present invention will now be described more fully hereinafter with reference to the accompanying drawings, in which various embodiments of the invention are shown. Unless otherwise defined, terms used herein have the same meaning as commonly understood by one of ordinary skill in the art to which this invention pertains. Although methods and materials similar or equivalent to those described herein can be used in the practice or testing of the present invention, suitable methods and materials are described below. In addition, materials, methods and examples given are illustrative in nature only and not intended to be limiting. Accordingly, this invention may be embodied in different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

FIGS. 1–11 illustrate embodiments of a swim fin 20 comprising a foot portion 22 and a web portion 24. The foot portion 22 has a shoe 26 for receiving the foot of a wearer and a plurality of openings 28 in the toe end 30 of the foot portion. The web portion 24 of the swim fin 20 extends forwardly from the foot portion 22 and has a first end 32, a second end 34, a plurality of support members 36 having web material 38 associated therewith, and a plurality of bosses 40 positioned adjacent the first end. The bosses 40 connect the web portion 24 of the swim fin 20 to the foot portion 22 by connecting with the plurality of openings 28. The connection whereby the bosses 40 are connected in the plurality of openings 28 may be detachable, so as to allow a user to disconnect the web portion 24 of the swim fin 20 from the foot portion 22, if desired. The bosses 40 are preferably members which extend outwardly from a surface of the web portion 24 of the fin, the outward extent of the bosses being engageable with the openings 28 on the foot portion 22 of the fin. Additionally, the skilled will understand that the plurality of bosses 40 may alternatively be positioned on the foot portion 22 of the swim fin 20, and the plurality of openings 28 may be positioned on the web portion 24, the connection therebetween rendering substantially the same result. Moreover, while the plurality of bosses 40 is described as a preferred embodiment of the invention, the skilled artisan will recognize that any other mechanical connection by which foot portion 22 and web portion 24 may be connected together with the swim fin providing the desired flexible motion is intended to be included within the scope of the invention.

It should be understood that the term "shoe" as used herein with reference to the foot portion 22 of the swim fin is intended to include any structural arrangement which permits a wearer to contact the swim fin with his or her foot and to secure the swim fin to the foot for use. Accordingly, for example, "shoe" may include a generally elongated chamber formed in the foot portion 22 of the swim fin and having an opening large enough to insert a foot therein. By way of further example, a "shoe" in the foot portion 22 of the fin 20 may be shaped similarly to a typical sandal, wherein the swim fin has a surface area having the general outline of a human foot, and having one or more straps to secure the foot thereto. In yet an additional example, the "shoe" may be a chamber of sufficient size to therein receive the forward portion of a user's foot, and having connected thereto a strap which may be secured around the heel part of the user's foot to secure the fin onto the foot. Those and other arrangements as understood by the skilled for securing the swim fin in contact with the foot are intended to be included within the meaning of the term "shoe" as employed herein and recited in the claims.

Figure 2:
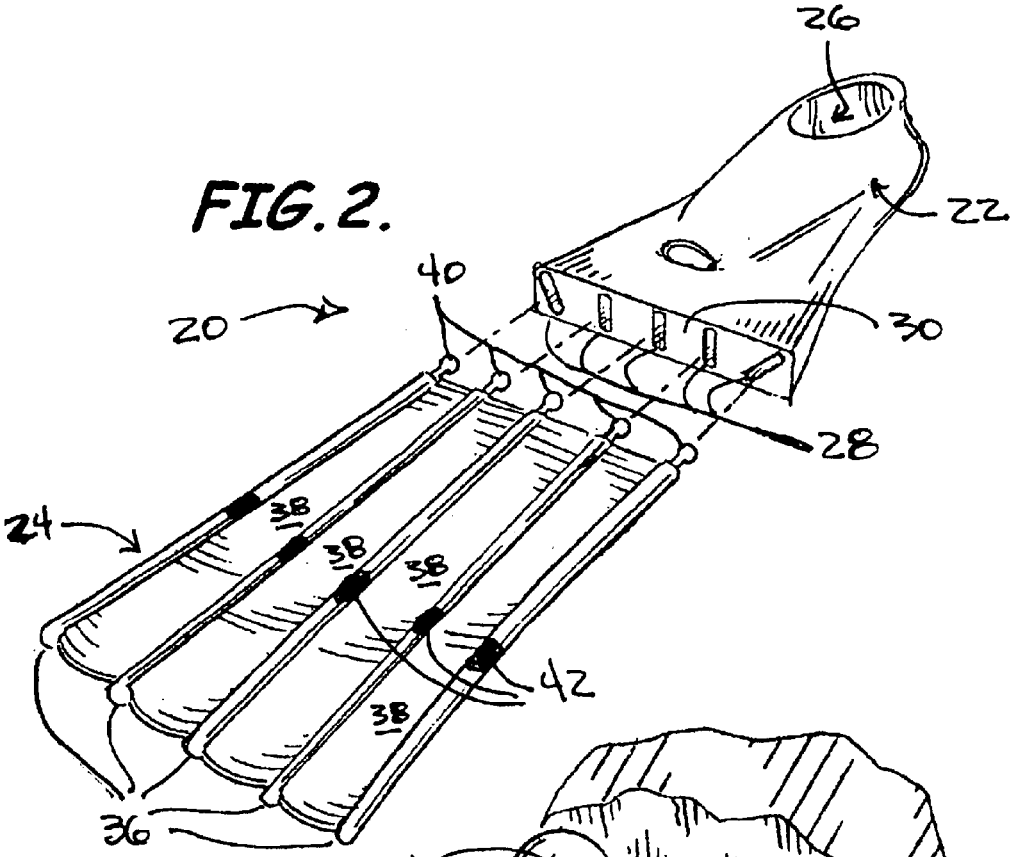
FIG. 2 is a top perspective exploded view of the swim fin of FIG. 1.
Figure 3:
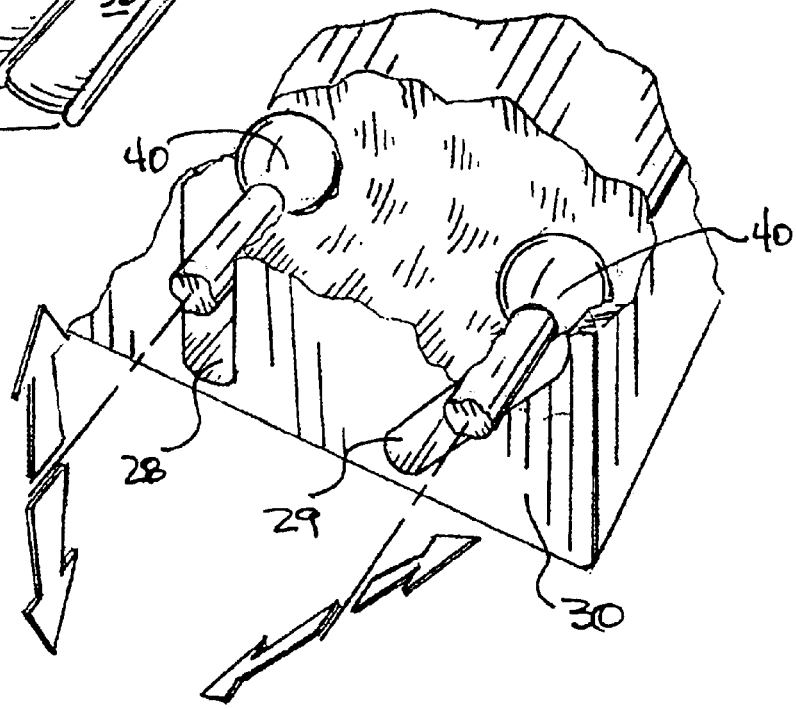
FIG. 3 shows a partial cutaway view of bosses in the web portion of the present swim fin engaging slots of the foot portion.
Figure 4:
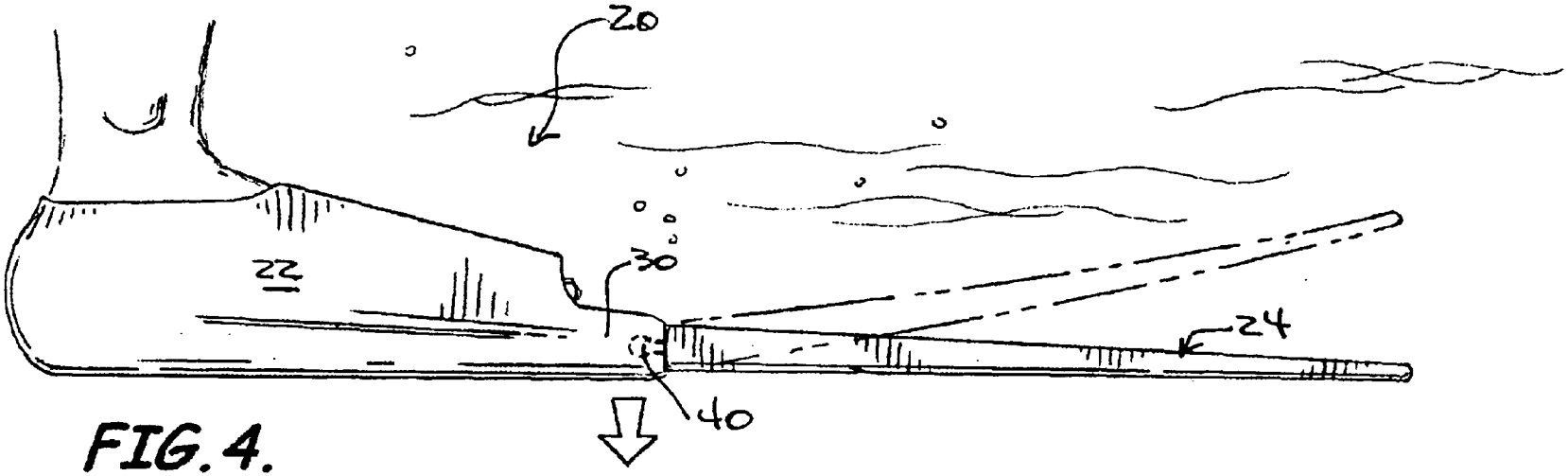
FIG. 4 is a side elevation view showing a flexing action of the present swim fin in a downward power stroke.
Figure 5A:
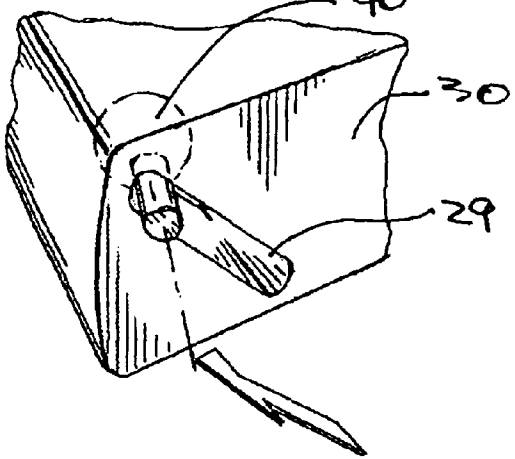
FIG. 5A is a partial cutaway view showing the boss-slot connection as the boss moves upwardly in an angled slot in the swim fin of FIG. 5.
Figure 5:
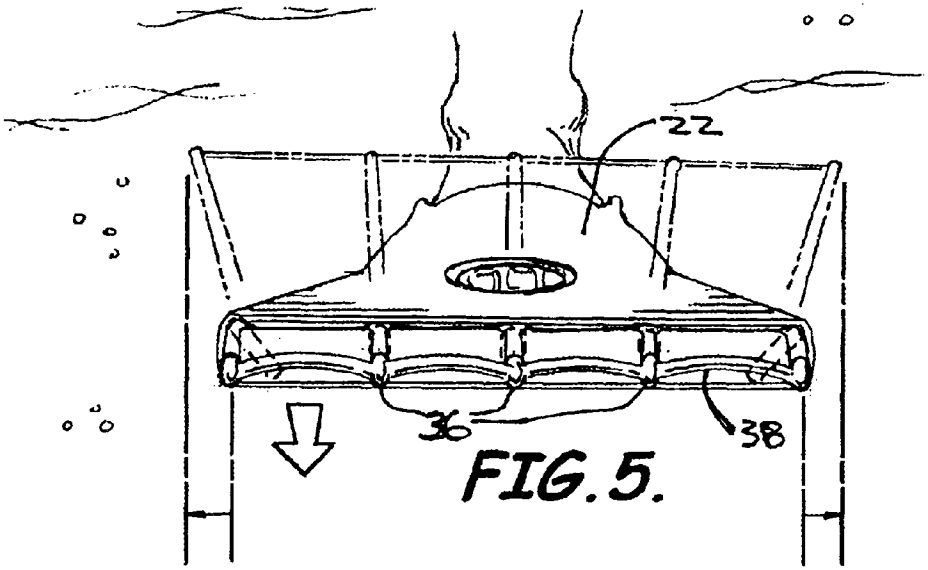
FIG. 5 is a front elevation view illustrating the present swim fin during a power stroke by a swimmer and the flexing action which expands the web portion of the fin.
Figure 7A:
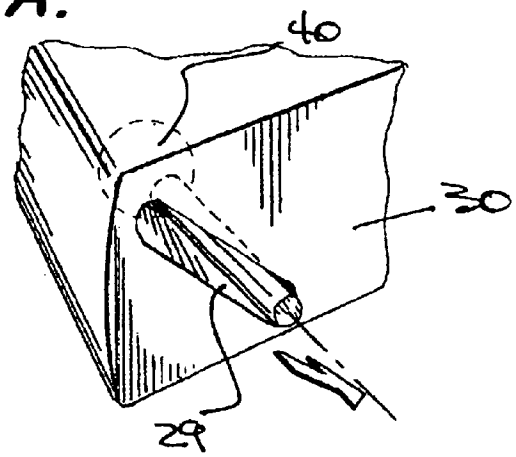
FIG. 7A is a partial cutaway view showing the boss-slot connection as the boss moves downwardly in an angled slot in the swim fin of FIG. 7.

In one preferred embodiment of the swim fin 20, as shown in FIGS. 23, the plurality of openings 28 comprises elongated openings positioned in a generally perpendicular orientation to an imaginary plane lying along a lower surface of the foot portion. As seen in FIG. 2, the plurality of openings 28 may also comprise an array of spaced apart slots positioned in generally perpendicular orientation to an imaginary plane lying along a lower surface of the foot portion, wherein at least first and last slots of the array are oriented at an angle to the imaginary plane. It should be understood, however, that the plurality of openings may include all slots oriented at an angle to the imaginary plane, or may include only some of the slots oriented at an angle, depending on the degree of flexing desired in the fin during use. The plurality of bosses 46 is preferably positioned slidably connected within the openings 28, as is depicted in FIGS. 3, 5 and 7A. That is, during use of the swim fin, the bosses 40 may move within the openings 28, which movement helps provide additional flexing in the web portion.

The web portion 24 of the swim fin 20 includes a plurality of support members 36 which are variously described in embodiments of the invention. The support members are best shown in FIGS. 2, 5, 7, and 8–11. In one embodiment of the fin, the plurality of support members 36 comprises at least one or more flexible support members. Web material 38 is associated with the support members 36 and may extend between individual support members of the plurality of support members, as illustrated in FIGS. 2, 5, 7, and 8–11. The associated web material 38 may also be above or below the support members 36 in such a way as to derive sufficient support therefrom. The embodiment of the swim fin 20 shown in FIG. 2 includes a first and a last support member positioned to define lateral peripheries of the web portion 24. The plurality of support members 36 may also comprise at least one elongated support member which extends along a lengthwise dimension from the first end 32 to the second end 34 of the web portion 24, and which is relatively flexible. The skilled will understand that the web material 38 is connected to the plurality of support members 36 in some fashion to derive support therefrom, and may even be integral with the support members, particularly if both are made of the same material and in one mold.

Additionally, as shown in FIG. 2, in one embodiment of the invention one or more of the support members in the web portion of the fin may be disposed with one or more hinges 42 or flexible joints along its lengthwise extent, the hinge allowing further flexibility in the support member. Preferably, such a hinge 42 or flexible joint is positioned to allow the support member 36 to be fully extended during the fin's power stroke, and to bend so as to increase flexing in the fin's web portion 24 during the return stroke. The hinge 42 or flexible joint may be mechanical or may be a portion of the support member which possesses different flexibility characteristics than the rest of the support member, for example, by being made of a modified material.

Figure 10:
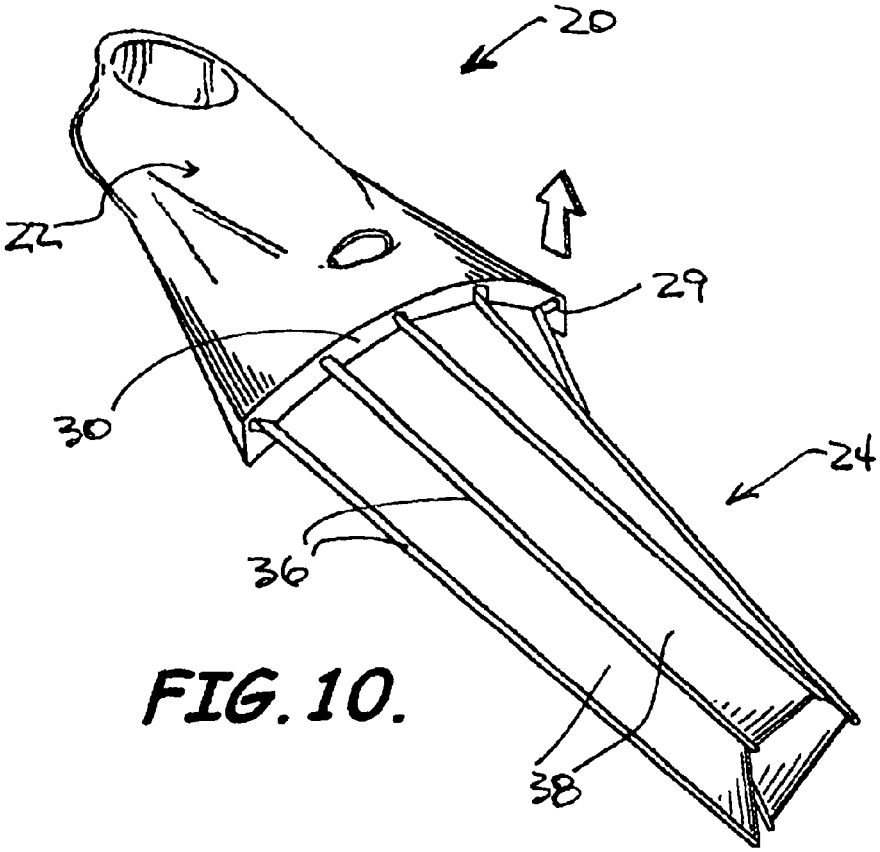
FIG. 10 is an embodiment of the swim fin of FIG. 1 wherein the toe end of the foot portion has a downwardly curved arch, which tends to allow further closing of the web portion during a return stroke.
Figure 11:
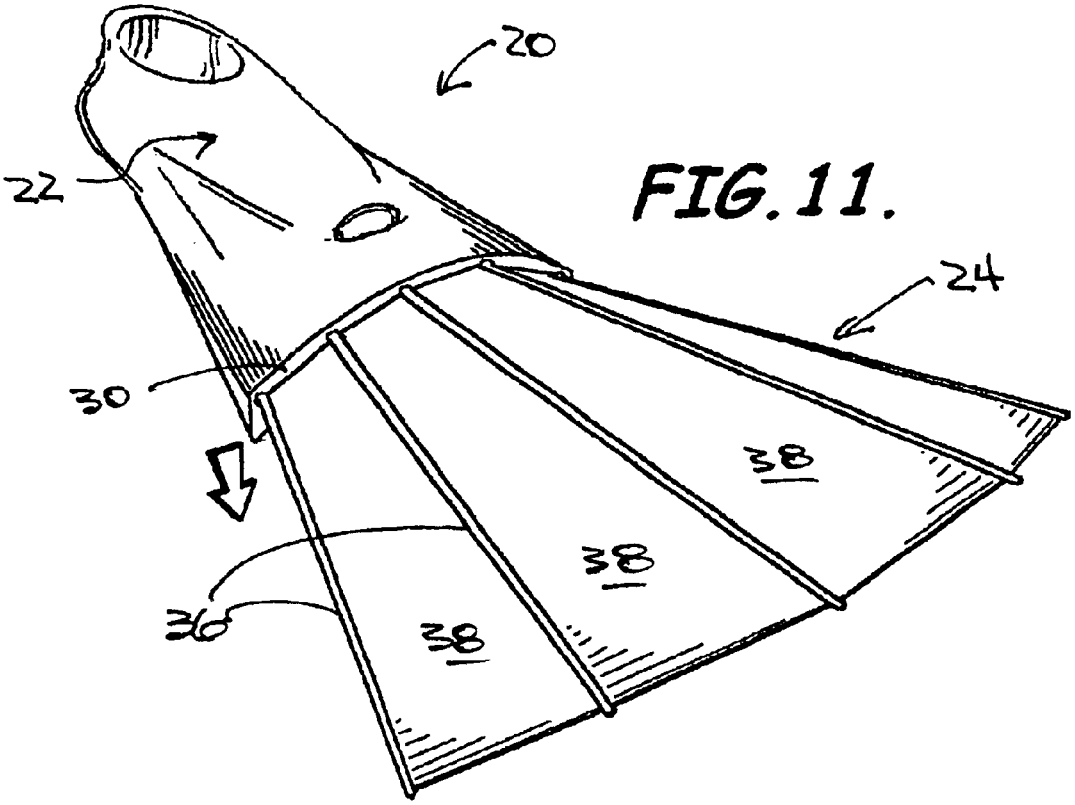
FIG. 11 shows the swim fin of FIG. 10 wherein the power tends to more fully spread open the web portion of the fin.
Figure 12:
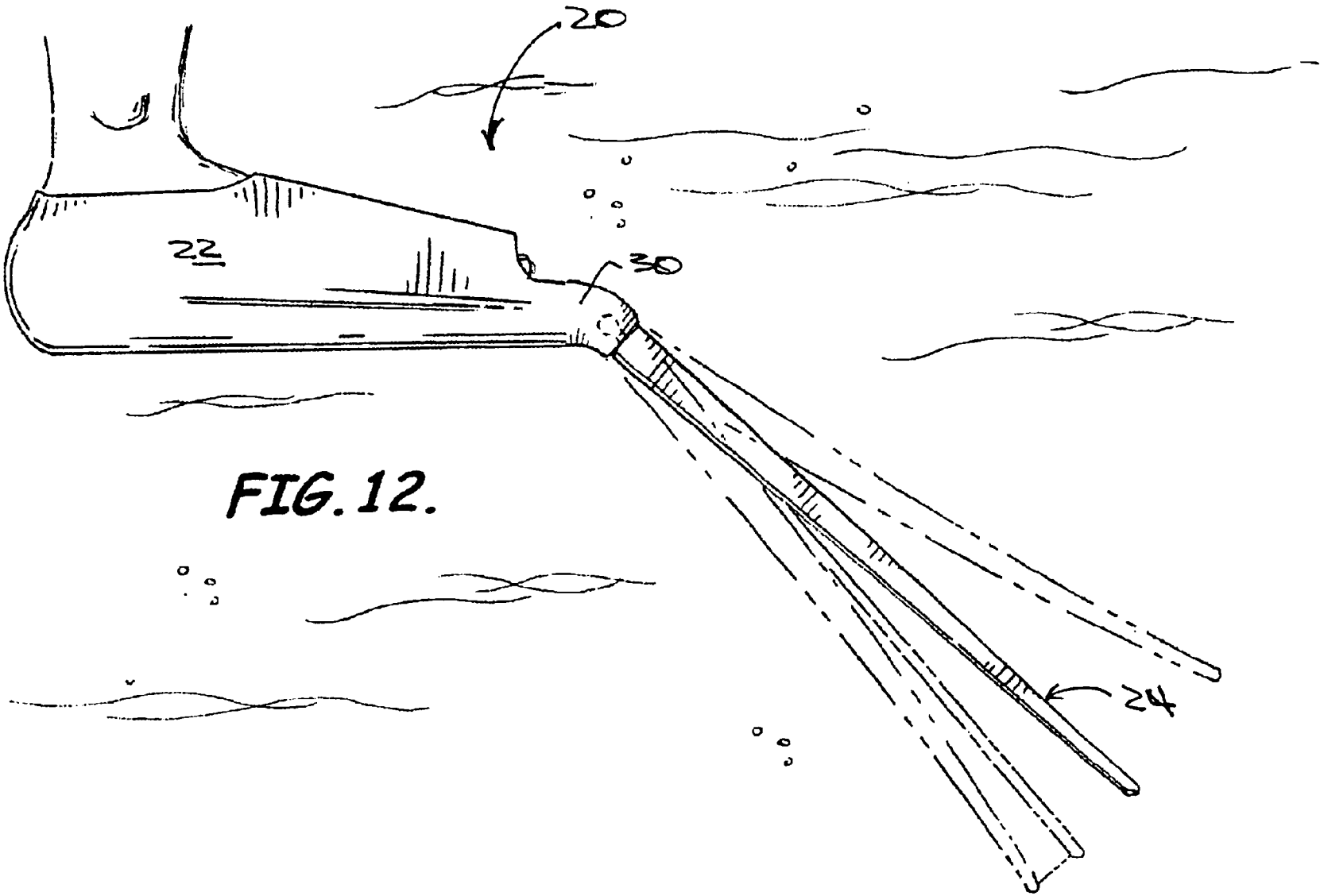
FIG. 12 is a side elevation view of the present swim fin in use, wherein the toe end of the foot portion of the fin has an arch having a curvature oriented along a lengthwise extent of the fin.

In yet another embodiment of the swim fin 20, the foot portion 22 has a toe extending forwardly from the shoe, the toe having a toe end 30 which is arch-shaped, as illustrated in FIGS. 10–12. In a preferred embodiment the toe arch extends across the width of the toe from one lateral periphery to the opposite lateral periphery of the shoe portion, as seen in FIGS. 10–11. The skilled will recognize that the toe end 30 being arched in this manner will result in some added curvature of the web portion 24 when connected thereto by engagement of the plurality of bosses 40 with the plurality of openings 28 on the toe end 30 of the foot portion 22. The toe end 30 may curve downwardly or upwardly relative to the fin, according to preference. As seen in FIG. 12, in another embodiment of the present swim fin 20 the curvature of the toe end 30 arch may alternatively be oriented along a lengthwise axis of the fin so that the web portion is not generally parallel to an imaginary plane extending along a lower surface of the foot portion of the fin.

Figure 6:
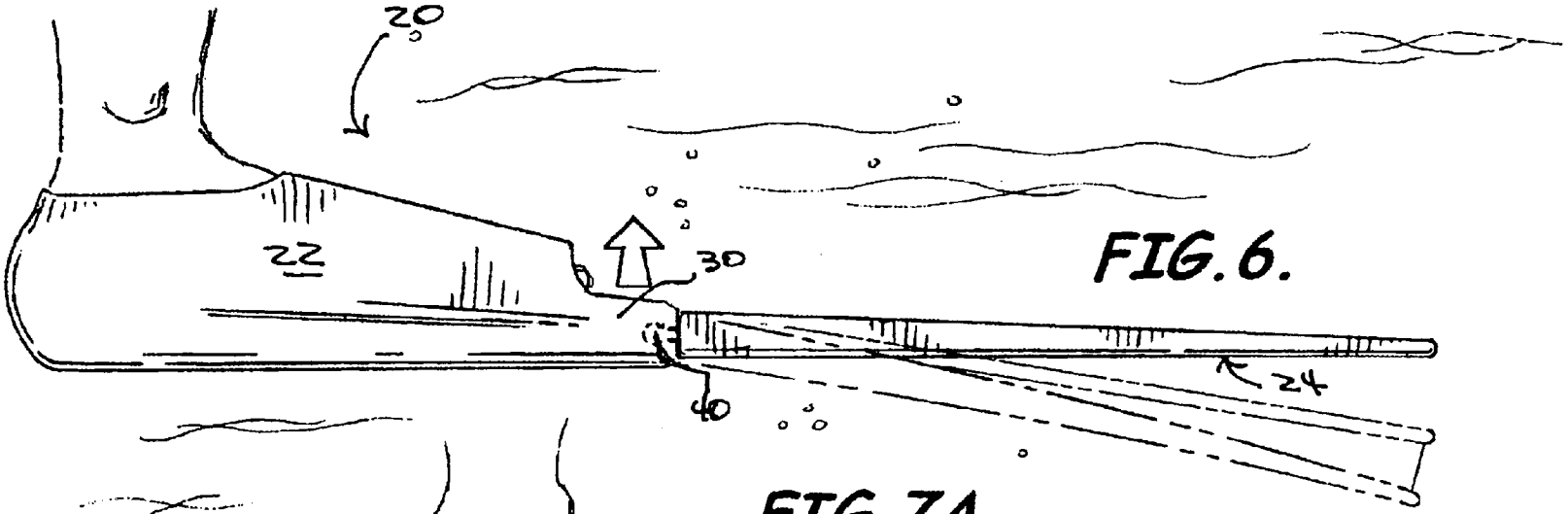
FIG. 6 is a side elevation view showing a flexing action of the present swim fin in an upward return stroke.
Figure 7:
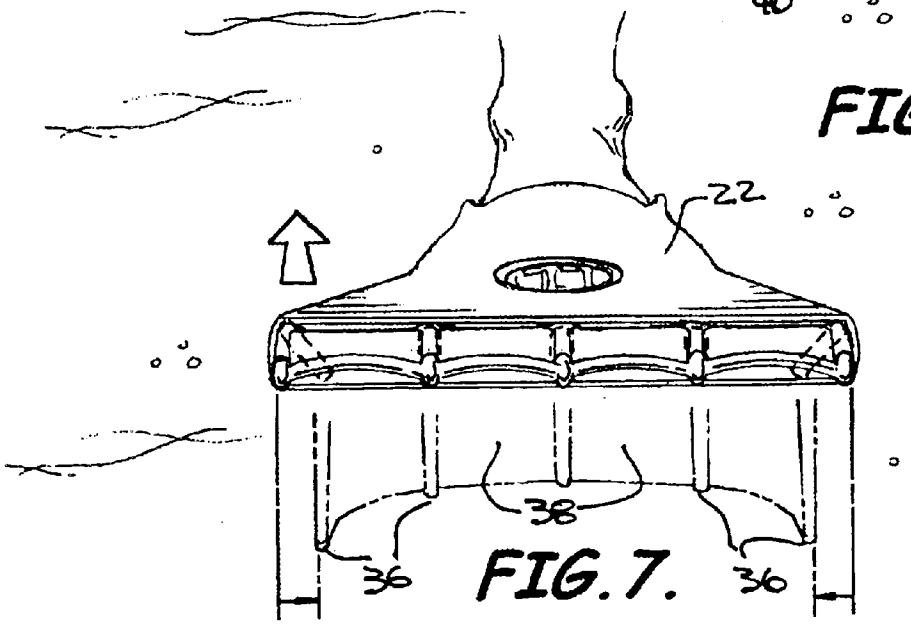
FIG. 7 is a front elevation view illustrating the present swim fin during a return stroke by a swimmer and the flexing action which contracts the web portion of the fin.

The added curvature of the web portion 24 provided by an arched toe end 30 will promote the flexing action of the web portion during use of the fin, aiding in simulating the closing and opening action of a frog's foot during swimming. For example, as shown in FIGS. 1 and 4–5A, during the downward power stroke of the fin (FIG. 4), the web portion 24 of the fin tends to spread out to provide increased power (FIG. 5). The spreading movement of the web portion is promoted by one or more bosses 40 being slidingly connected with the angled slots 29 on the toe end 30 of the foot portion 22 of the fin (FIG. 5A). Conversely, during the upward return stroke of the swim fin, as shown in FIGS. 6–7A, the opposite action occurs. As the return stroke progresses (FIG. 6), one or more bosses 40 are urged downwardly along their connecting angled slots 29 (FIG. 7A), and the web portion 24 of the swim fin 20 tends to close (FIG. 7).

Figure 8:
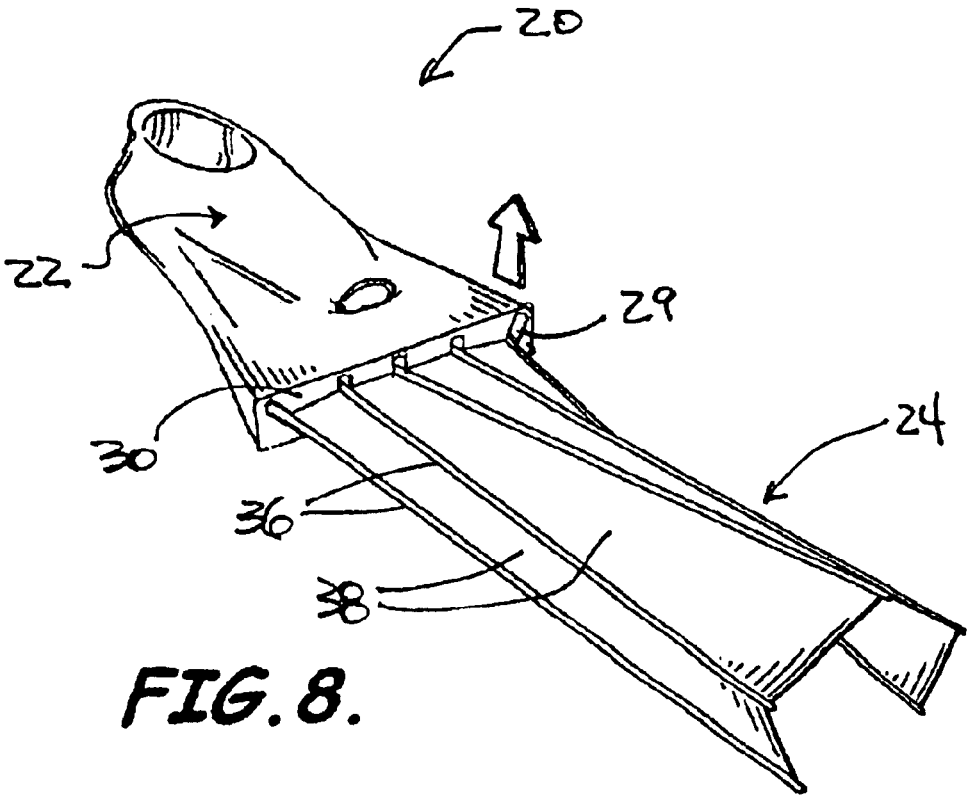
FIG. 8 shows a swim fin according to FIG. 1, wherein a return stroke tends to close the web portion of the fin.
Figure 9:
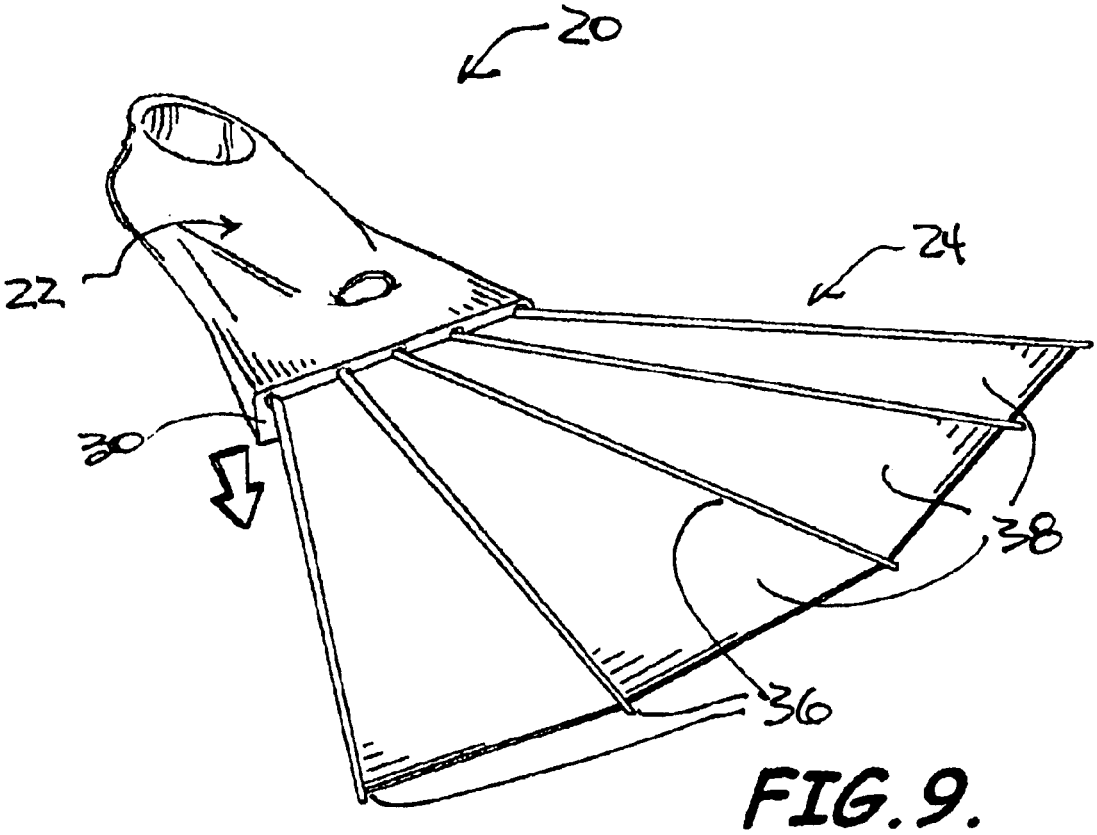
FIG. 9 illustrates the swim fin of FIG. 8, wherein a power stroke tends to spread open the web portion of the fin.

The web portion 24 will, therefore, have a tendency to flex along the toe end 30 aided by movement of the bosses 40 slidably connected with the openings 28 in the foot portion 22. The toe end 30 may be relatively straight, or may have a degree of curvature. The degree of opening and closing of the spread of the web portion 24 will tend to be smaller in a fin having a relatively straight toe end 30, as seen in FIGS. 8–9, and will tend to be more pronounced in a fin having a relatively curved toe end, as shown in FIGS. 10–11.

In this manner, the action of the web portion 24 of the swim fin 20 resembles that of the webbed foot of an amphibian, such as a frog, which tends to more fully spread during the power stroke in swimming, and tends to be less fully spread during the return stroke. Of course, in the present swim fin 20 the power stroke and return stroke will depend on the choice of whether the toe end curves downwardly or upwardly relative to the foot portion of the swim fin. It should be noted that, at the swimmer's preference, it is possible to wear a pair of swim fins in which one fin has its toe end generally curved upwardly and the other fin has its toe end generally curved downwardly, the web portions of the two fins being, therefore, generally opposite in their curvature. In this usage of the invention, the pattern of alternating power and return strokes would be different from the typical swimming pattern.

Method aspects of the described swim fins include a method of swimming comprising wearing at least one of the described swim fins while immersed in water. The method may additionally include wearing one swim fin wherein the toe end curves downwardly, and one swim fin wherein the toe end curves upwardly, to provide a different pattern of power and return strokes for the swimmer.

In the drawings and specification, there have been disclosed a typical preferred embodiment of the invention, and although specific terms are employed, the terms are used in a descriptive sense only and not for purposes of limitation. The invention has been described in considerable detailed with specific reference to these illustrated embodiments. It will be apparent, however, that various modifications and changes can be made within the spirit and scope of the invention as described in the foregoing specification and as defined in the appended claims.

What is claimed is:

1. A swim fin comprising, a foot portion having a shoe and a plurality of openings In a toe end of said foot portion;

a web portion extending from said foot portion and having a first end, a second end, a plurality of support members having web material associated therewith, and a plurality of bosses connected with said plurality of openings; and wherein said plurality of openings comprises an array of spaced apart slots, and wherein at least one slot of said array is positioned generally perpendicular to an imaginary plane lying alone a lower surface of said foot portion.

2. The swim fin of claim 1, wherein said plurality of openings comprises an array of spaced apart slots, and wherein at least first and last slots of said array are oriented at an angle to said imaginary plane.

3. The swim fin of claim 2, wherein said plurality of bosses detachably connects with said plurality of openings.

4. The swim fin of claim 1, wherein said plurality of openings comprises an array of spaced apart slots oriented at an angle to said imaginary plane.

5. The swim fin of claim 1, wherein said plurality of openings comprises elongated openings, and said plurality of bosses slidably connects with said plurality of elongated openings.

6. The swim fin of claim 1, wherein said plurality of support members comprises at least one support member having at least one hinge.

7. The swim fin of claim 1, wherein said web material extends between individual support members of said plurality of support members.

8. The swim fin of claim 1, wherein a first and a last support member of said plurality of support members are positioned to define lateral peripheries of said web portion.

9. The swim fin of claim 1, wherein said plurality of support members comprises at least one elongated support member.

10. The swim fin of claim 1, wherein said plurality of support members extends from said first end to said second end of said web portion.

11. The swim fin of claim 1, wherein said plurality of support members comprises at least one elongated support member extending along a lengthwise dimension of said web portion, said support member being relatively flexible.

12. A swim fin comprising:

a foot portion having a shoe for securing the foot of a wearer and having a toe extending forwardly on said foot portion, said toe having a toe end defining an arch from a first to a second lateral periphery of said foot portion and having a plurality of spaced apart slots arrayed along an arched surface of said toe end; and a web portion connected to said foot portion and having a first end, a second end, a plurality of support members having web material associated therewith, and a plurality of bosses positioned adjacent said first end and connected with said plurality of slots.

13. The swim fin of claim 12, wherein said plurality of spaced apart slots includes at least first and last slots of said array oriented at an angle relative to the remaining slots of said plurality.

14. The swim fin of claim 13, wherein said plurality of bosses detachably connects said plurality of slots.

15. The swim fin of claim 12, wherein said plurality of openings comprises an array of spaced apart slots positioned in generally non-perpendicular orientation to an imaginary plane lying along a lower surface of said foot portion.

16. The swim fin of claim 12, wherein said plurality of bosses slidably connects with said plurality of slots.

17. The swim fin of claim 12, wherein said plurality of support members comprises at least one support member having at least one hinge.

18. The swim fin of claim 12, wherein said web material extends between individual support members of said plurality of support members.

19. The swim fin of claim 12, wherein a first and a last support member of said plurality of support members are positioned to define lateral peripheries of said web portion.

20. The swim fin of claim 12, wherein said plurality of support members comprises at least one elongated support member.

21. The swim fin of claim 12, wherein said plurality of support members extends from said first end to said second end of said web portion.

22. The swim fin of claim 12, wherein said plurality of support members comprises at least one elongated support member extending along a lengthwise dimension of said web portion, said support member being relatively flexible.

23. A swim fin comprising:

a foot portion configured to receive the foot of a wearer and having a toe end including a plurality of slot openings; and a web portion having a plurality of elongated and relatively flexible support members, a plurality of bosses wherein each individual boss positioned at a first end of an individual support member, and web material associated with said plurality of support members, said web portion connected to said foot portion by the plurality of bosses being connected with said plurality of slot openings so that said web portion extends away from said toe end.

24. The swim fin of claim 23, wherein said plurality of slot openings comprises openings positioned generally perpendicular to an imaginary plane lying along a lower surface of said foot portion.

25. The swim fin of claim 23, wherein said plurality of slot openings comprises spaced apart slots wherein at least first and last slots of said plurality of slot openings are at a non-perpendicular angle to an imaginary plane lying along a lower surface of said foot portion.

26. The swim fin of claim 23, wherein said plurality of bosses detachably connects said plurality of slots.

27. The swim fin of claim 23, wherein said plurality of slot openings comprises spaced apart slots oriented at a non-perpendicular angle to an imaginary plane lying along a lower surface of said foot portion.

28. The swim fin of claim 23, wherein said plurality of openings comprises elongated openings, and said plurality of bosses is connected thereto so that at least one individual boss is slidably connected with an elongated opening.

29. The swim fin of claim 23, wherein said plurality of support members comprises at least one support member having at least one hinge.

30. The swim fin of claim 23, wherein said web material extends between individual support members of said plurality of support members.

31. The swim fin of claim 23, wherein a first and a last support member of said plurality of support members are positioned to define lateral peripheries of said web portion.

32. The swim fin of claim 23, wherein said plurality of support members comprises at least one elongated support member.

33. The swim fin of claim 23, wherein at least one individual support member of said plurality of support members extends from said first end to said second end of said web portion.

34. The swim fin of claim 23, wherein said plurality of support members comprises at least one elongated support member extending along a lengthwise dimension of said web portion, said support member being relatively flexible.

* * * * *